US005937471A

United States Patent [19]

Liao

[11] Patent Number: 5,937,471

[45] Date of Patent: Aug. 17, 1999

[54] MULTIPURPOSE FLOOR CLEANING DEVICE

[76] Inventor: Jih-Shun Liao, P.O. Box 23-487, Changhua City 500, Taiwan

[21] Appl. No.: 09/199,151

[22] Filed: Nov. 25, 1998

[30] Foreign Application Priority Data

Aug. 1, 1998 [TW] Taiwan ..... 87212683

[51] Int. Cl.[6] ..... A47L 13/12; A47L 13/20; A47L 13/46

[52] U.S. Cl. ..... 15/111; 15/144.1; 15/146; 15/147.2; 15/148; 15/176.1; 15/178; 15/228; 15/231

[58] Field of Search ..... 15/111, 146, 147.2, 15/150, 228, 148, 231, 144.1, 176.1, 178

[56] References Cited

U.S. PATENT DOCUMENTS 5,123,138 6/1992 Flamm ..... 15/111
5,410,772 5/1995 Lewis ..... 15/228
5,426,809 6/1995 Muta ..... 15/231
5,461,749 10/1995 Ahlberg ..... 15/231

*Primary Examiner*—Randall E. Chin

[57] ABSTRACT

A multipurpose mop is composed of a head, a neck, an urging mechanism, and a handle. The head is composed of an upper member and a lower member which is joined with the upper member by a retaining rod. The neck has a cross rod and a fastening portion. The neck is fastened with the head by the retaining rod which is put through a through hole of the cross rod of the neck. The fastening portion of the neck is engaged with the tubular head and the nut of the urging mechanism. The handle is fastened at one end thereof with the fastening portion of the neck via the urging mechanism. The head can be turned by the urging mechanism so as to position the head to maximize the cleaning effect. The head is capable of holding a mopping cloth, a bundle of bristles and a floor scraper.

3 Claims, 14 Drawing Sheets

MULTIPURPOSE FLOOR CLEANING DEVICE

FIELD OF THE INVENTION

The present invention relates generally to a floor cleaning device, and more particularly to a floor cleaning device which can be used as a mop, a carpet sweeper, a broom, a floor scraper, etc.

BACKGROUND OF THE INVENTION

As shown in FIG. 14, a static mop of the prior art is provided with a piece of disposable static paper which is attached to the press plate of the static mop for cleaning the floor and the like. The static paper is effective in cleaning the floor and is disposed of after use. The static mop is therefore a handy household item. Like other conventional floor cleaning devices, such as mop, sweeper and broom, the static mop is designed for only one purpose. In short, it is not economical to keep a variety of conventional floor cleaning devices which also take up much of the storage space.

SUMMARY OF THE INVENTION

It is therefore the primary objective of the present invention to provide a multipurpose floor cleaning device which is handy and economical.

In keeping with the principle of the present invention, the foregoing objective of the present invention is attained by the multipurpose floor cleaning device consisting of a head, a neck, an urging mechanism, and a handle. The head is composed of an upper member and a lower member which is joined with the upper member by a retaining rod. The neck has a cross rod and a fastening portion. The neck is fastened with the head by the retaining rod which is put through a through hole of the cross rod of the neck. The fastening portion of the neck is engaged with the tubular head and the nut of the urging mechanism. The handle is fastened at one end thereof with the fastening portion of the neck via the urging mechanism. The head can be turned by the urging mechanism so as to position the head to maximize the cleaning effect. The head is capable of holding a mopping cloth or paper, a bundle of bristles, and a floor scraper.

The foregoing objective, features, functions, and advantages of the present invention will be more readily understood upon a thoughtful deliberation of the following detailed description of the present invention with reference to the accompanying drawings.

DETAILED DESCRIPTION OF THE INVENTION

Figure 1:
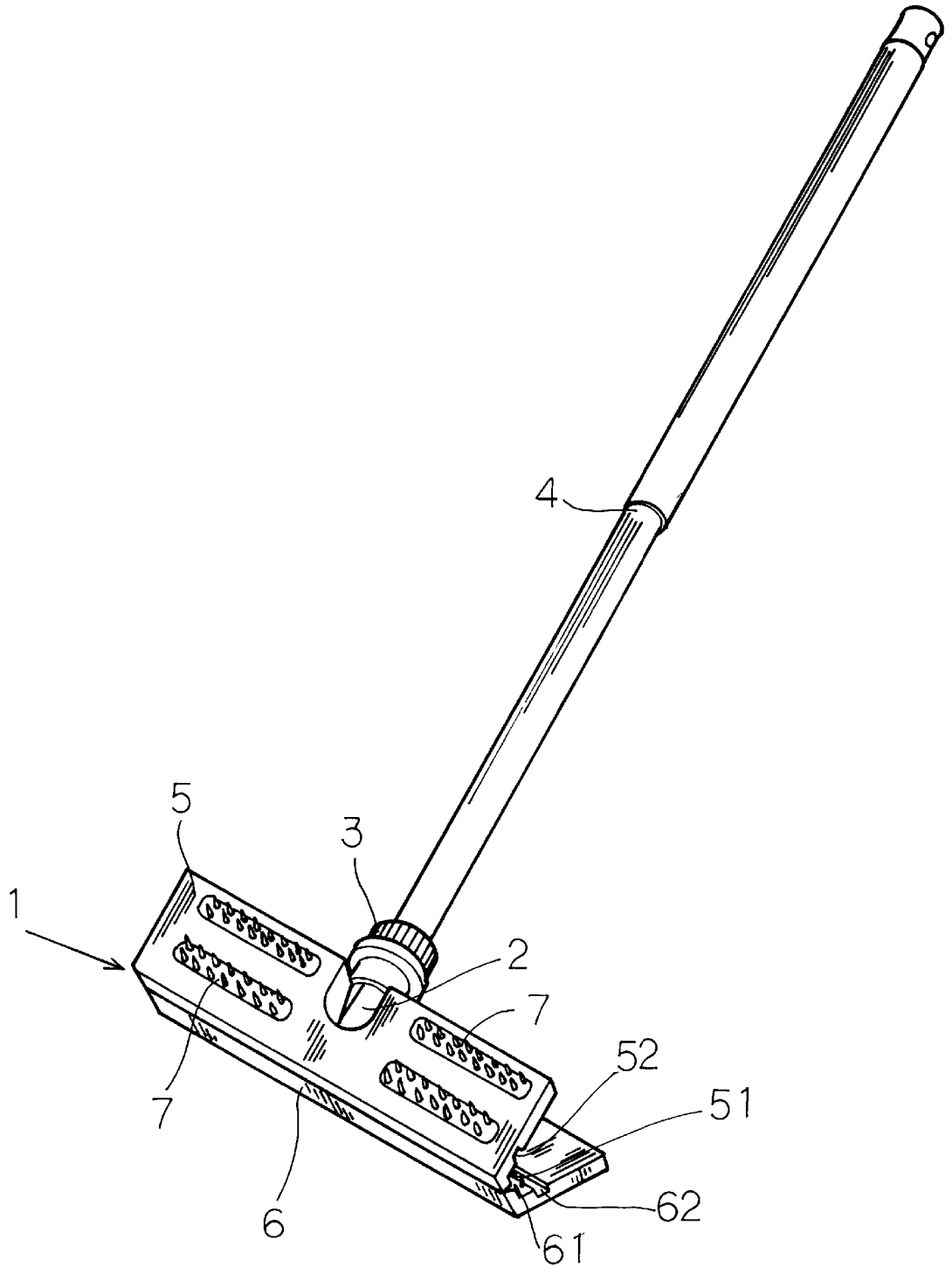
FIG. 1 shows a perspective view of the present invention.
Figure 2:
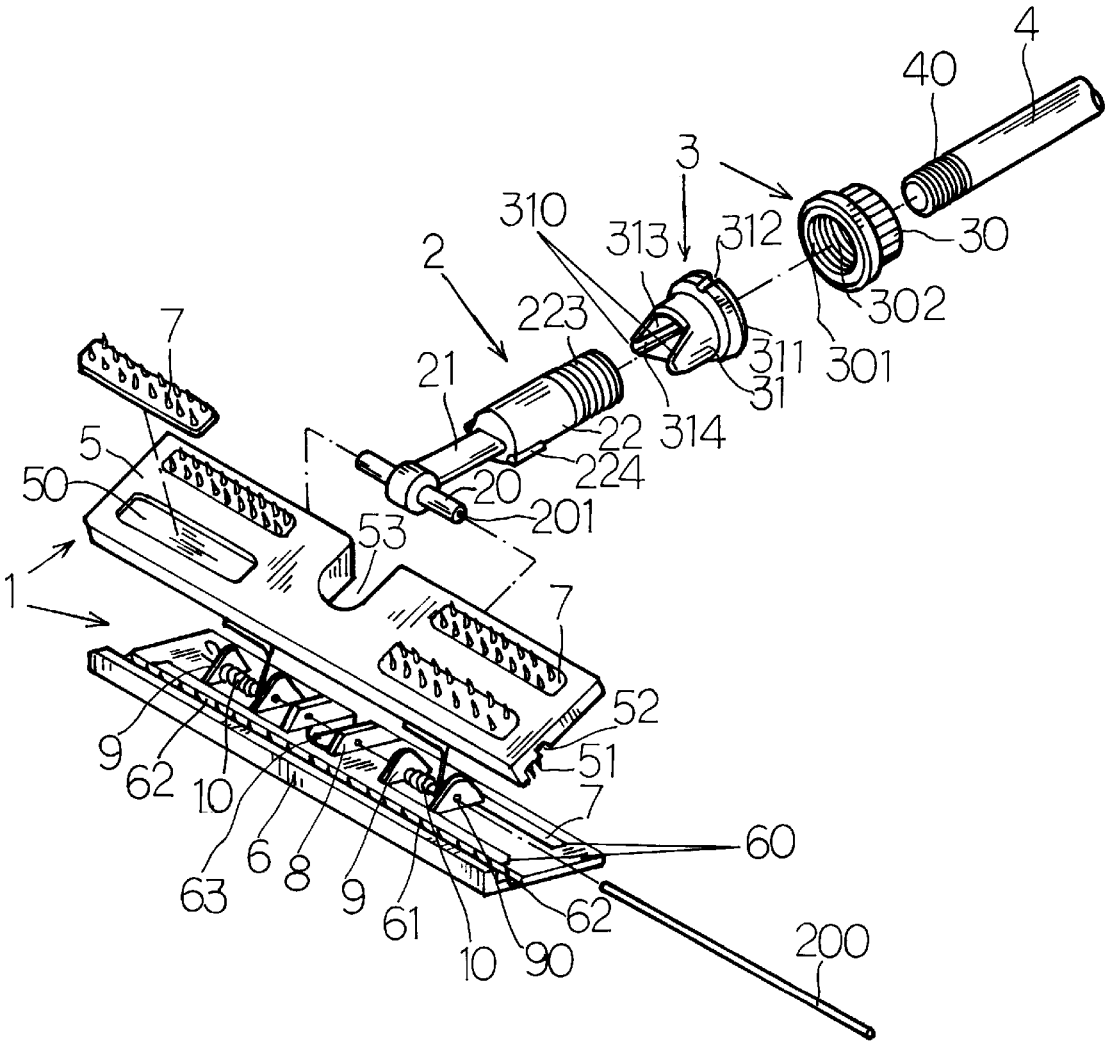
FIG. 2 shows an exploded view of the present invention.

As shown in FIGS. 1–5, a mop embodied in the present invention is composed of a head 1, a neck 2, an urging mechanism 3, and an expandable handle 4.

The head 1 is made up of an upper member 5 of a rectangular construction, and a lower member 6 corresponding in shape and size to the upper member 5. The upper member 5 is provided in the upper surface thereof with a plurality of receiving slots 50 and a plurality of retaining pieces 7 which are dimensioned to fit securely into the receiving slots 50 and are respectively provided in the upper surface thereof with a plurality of tapered knobs. The upper member 5 is further provided in an underside thereof with a plurality of toothed rows 51 extending along the edge of one longitudinal side of the rectangular upper member 5. The upper member 5 is still further provided in the underside thereof with a groove 52 extending in the proximity of the toothed rows 51. The upper member 5 is still further provided at the center of other one of the two longitudinal sides thereof with a cut 53. Located in the proximity of the cut 53 is protruded seat 8 (not shown in the drawing). The upper member 5 is still further provided in the underside thereof with two locating sets 9 (not show in the drawing). Each of the retaining sets 9 has two retaining blocks which are opposite to each other at an interval. The retaining blocks are provided correspondingly and respectively with a through hole 90 (not shown in the drawing). The lower member 6 is provided in the upper surface thereof with a plurality of receiving slots 60 and a plurality of retaining pieces 7 which are dimensioned to fit securely into the receiving slots 60 and are respectively provided in the upper surface thereof with a plurality of tapered knobs. The lower member 6 is further provided in the upper surface thereof with a plurality of toothed rows 61 corresponding in location to the toothed rows 51 of the upper member 5. The lower member 6 is still further provided in the upper surface thereof with a groove 62 corresponding in dimension and location to the groove 52 of the upper member 5 such that the grooves 62 and 52 form jointly a slide groove at such time when the upper member 5 and the lower member 6 are joined together. The lower member 6 is still further provided with a cut 63 corresponding in location to the cut 53 of the upper member 5. Located in the proximity of the cut 63 is a protruded seat 8. The lower member 6 is still further provided in the upper surface thereof with two retaining sets 9 each having two retaining blocks which are opposite to each other at an interval and are located between the two retaining blocks of the corresponding retaining set 9 of the upper member 5 when the upper member 5 and the lower member 6 are joined together. Located between the two retaining blocks of each retaining set 9 of the lower member 6 is a spring 10. The retaining blocks of the retaining sets 9 of the lower member 6 are provided respectively with a through hole 90. The through holes 90 of the retaining sets 9 of the upper member 5 and the lower member 6 are aligned such that a retaining rod 200 is put through the through holes 90 of the retaining sets 9 of the upper member 5 and the lower member 6, and that the springs 10 are fitted over the retaining rod 200.

The neck 2 is of a T-shaped construction and is provided at a head end thereof with a cross rod 20 having a through hole 201. The neck 2 is fastened with the head 1 such that the cross rod 20 is located in the space between the two retaining sets 9 of the head 1, and that the retaining rod 200 is received in the through hole 201 of the cross rod 20. The neck 2 is further composed of a shank 21 extending from the head end such that the shank 21 is perpendicular to the cross rod 20. The neck 2 is still further composed of a fastening portion 22 of a tubular construction and extending from the free end of the shank 21. The fastening portion 22 is provided in the axial hole 221 thereof with inner threads 222, and in the outer wall of a free end thereof with outer threads 223. The fastening portion 22 is further provided in the outer wall thereof with two locating ridges 224 opposite to each other and contiguous to the shank 21.

The urging mechanism 3 is composed of a nut 30 and a tubular head 31. The nut 30 is provided in the inner wall of one end thereof with a circular retaining groove 301 and inner threads 302. The tubular head 31 is provided at one end thereof with two tapered walls 310, and at other end thereof with a circular retaining protrusion 311 and an indentation 312. The tubular head 31 is provided in the inner wall of an axial hole 313 thereof with two locating grooves 314. The tubular head 31 is engaged with the nut 30 such that the circular retaining protrusion 311 of the tubular head 31 is retained in the circular retaining groove 301 of the nut 30. The urging mechanism 3 is fitted over the fastening portion 22 of the neck 2 such that the two locating ridges 224 of the fastening portion 22 are securely located in the two locating grooves 314 of the tubular head 31, and that the outer threads 223 of the fastening portion 22 are engaged with the inner threads 302 of the nut 30. The tubular head 31 can be caused to displace back and forth by turning the nut 30.

The handle 4 is provided at one end thereof with outer threads 40 and is fastened with the neck 2 via the urging mechanism 3 such that the handle 4 is put through the nut 30 and the tubular head 31, and that the outer threads 40 of the handle 4 are engaged with the inner threads 222 of the axial hole 221 of the fastening portion 22 of the neck 2.

Figure 6:
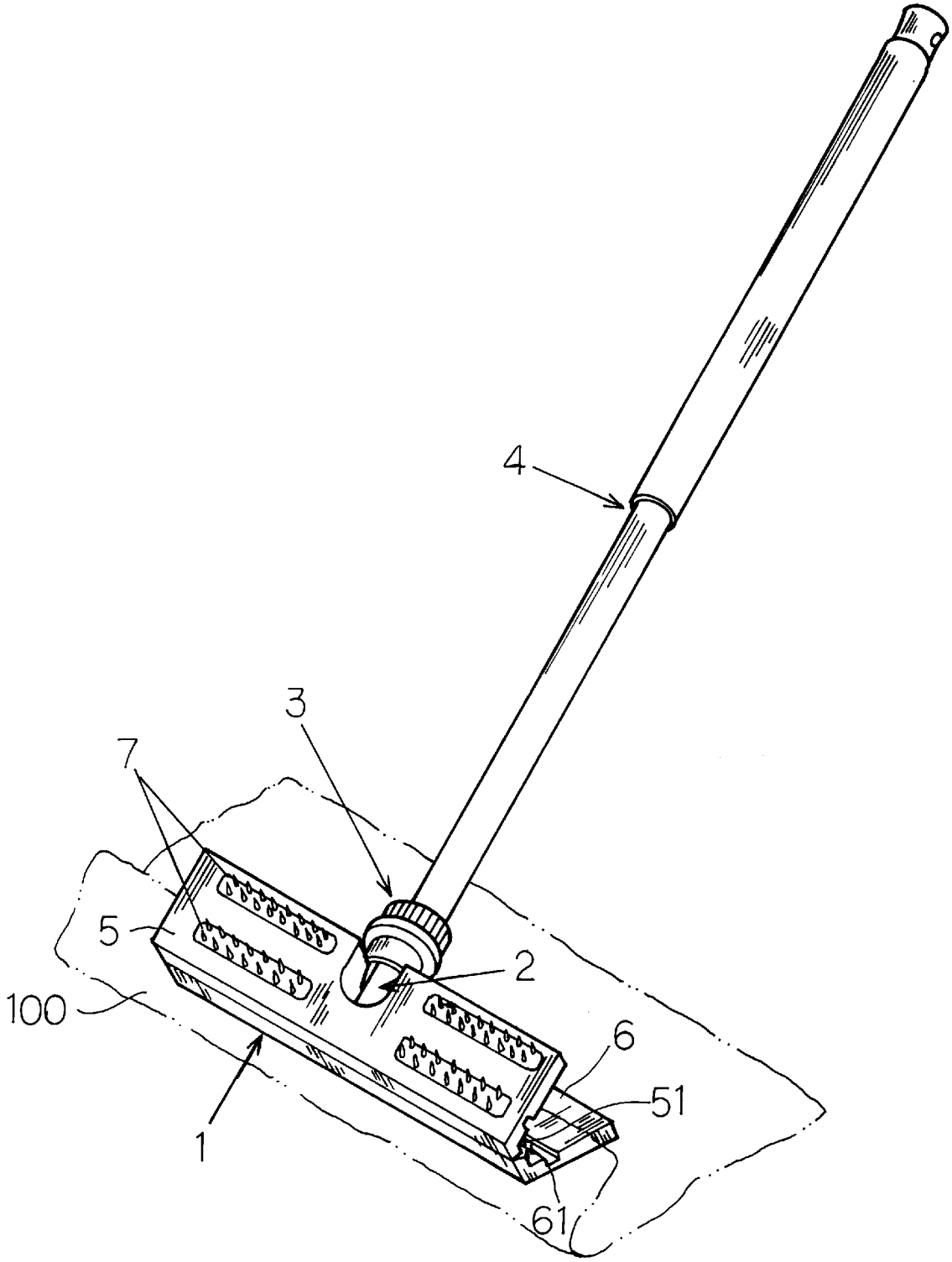
FIG. 6 shows a schematic view of the present invention in conjunction with a mopping cloth or paper.
Figure 7:
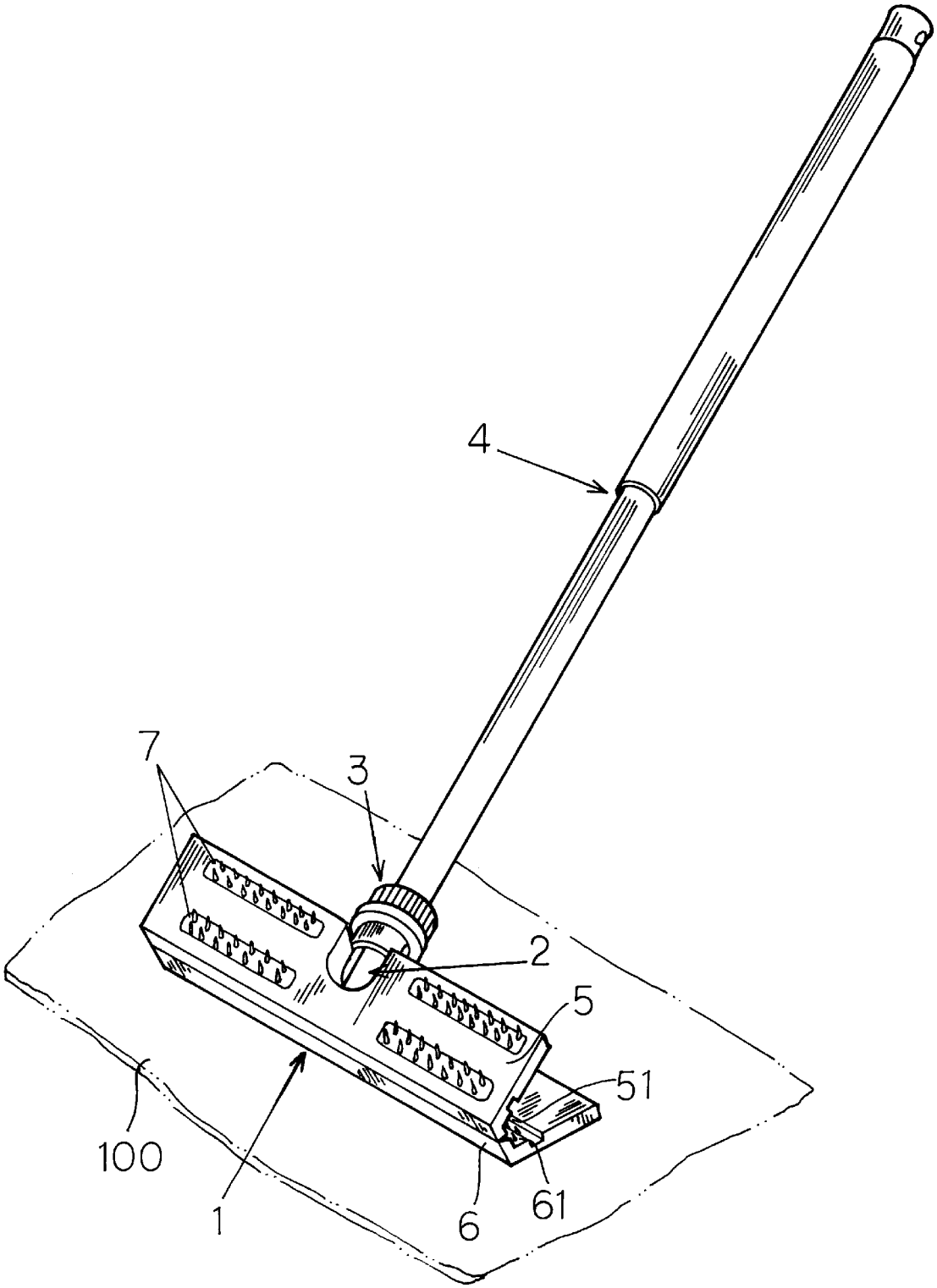
FIG. 7 shows another schematic view of the present invention in conjunction with a mopping cloth or paper.

As shown in FIG. 6, the mop of the present invention is capable of cooperating with a disposable mopping cloth 100 which is retained securely by the toothed rows 51 of the upper member 5 and the toothed rows 61 of the lower member 6 of the head 1.

Figure 8:
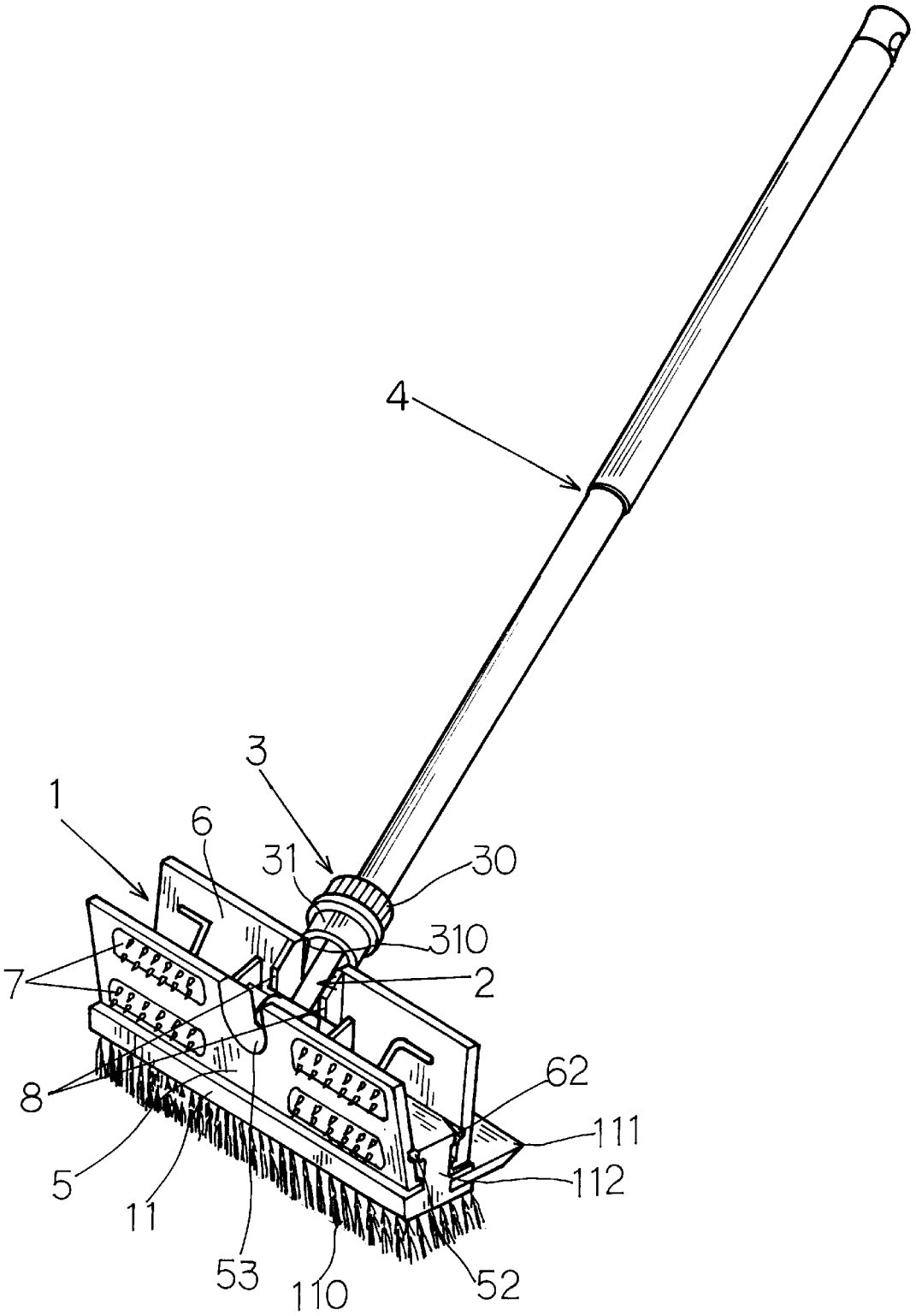
FIG. 8 shows a sectional schematic view of the present invention in conjunction with a brush forming an angle of 45 degrees with the handle of the present invention.
Figure 9:
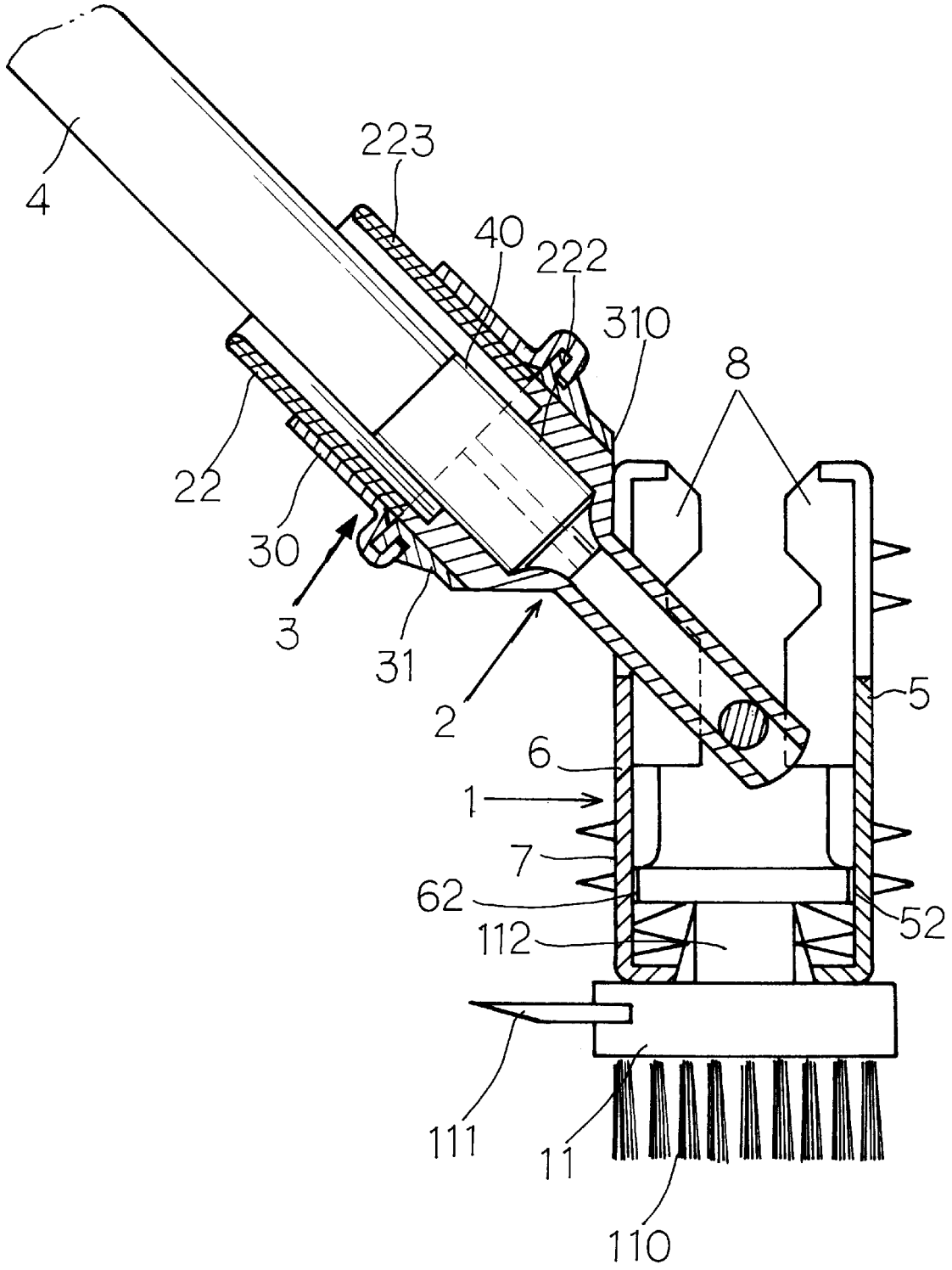
FIG. 9 shows a schematic perspective view of the present invention as shown in FIG. 8.
Figure 10:
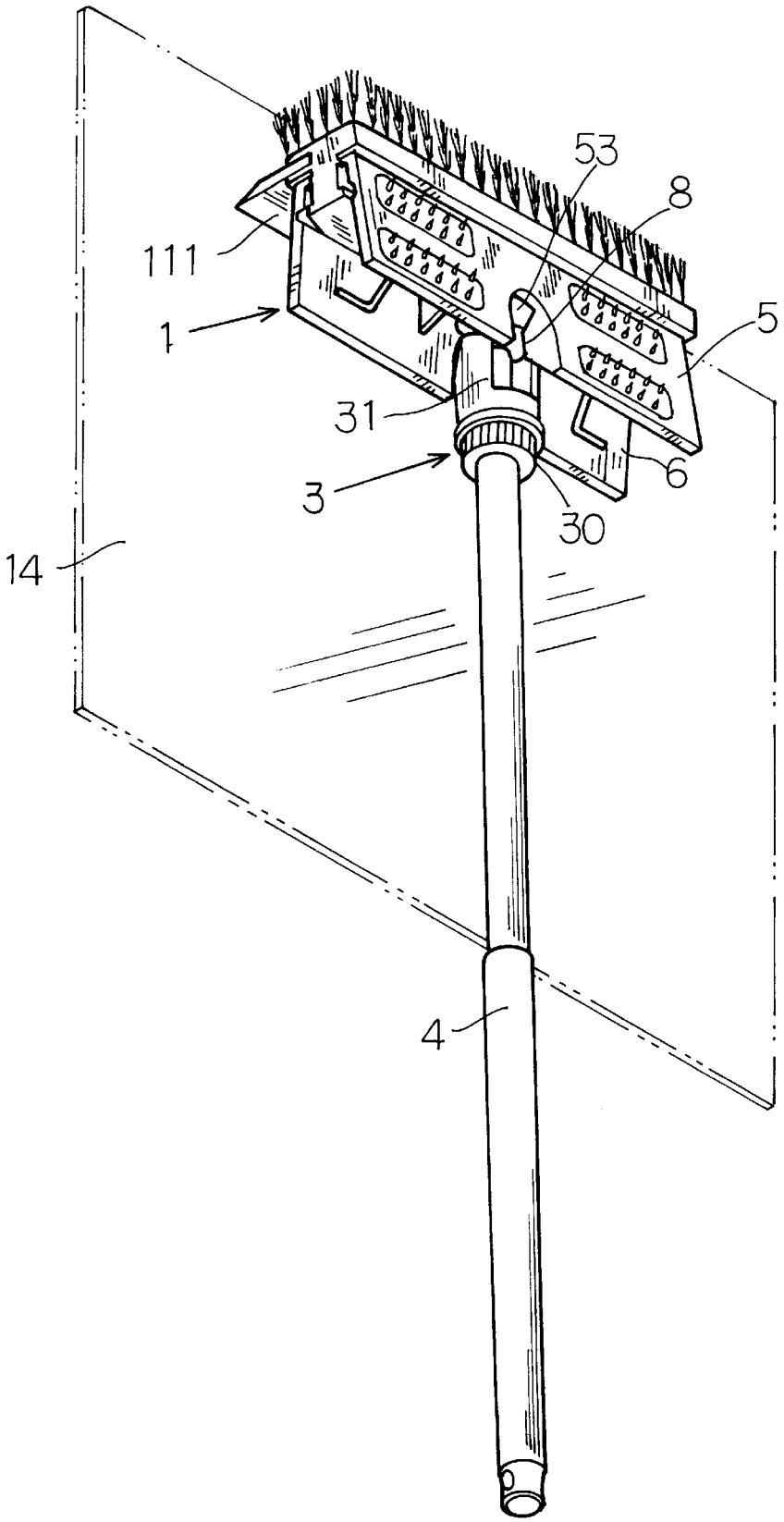
FIG. 10 shows a schematic view of the present invention in use as a scraper.
Figure 11:
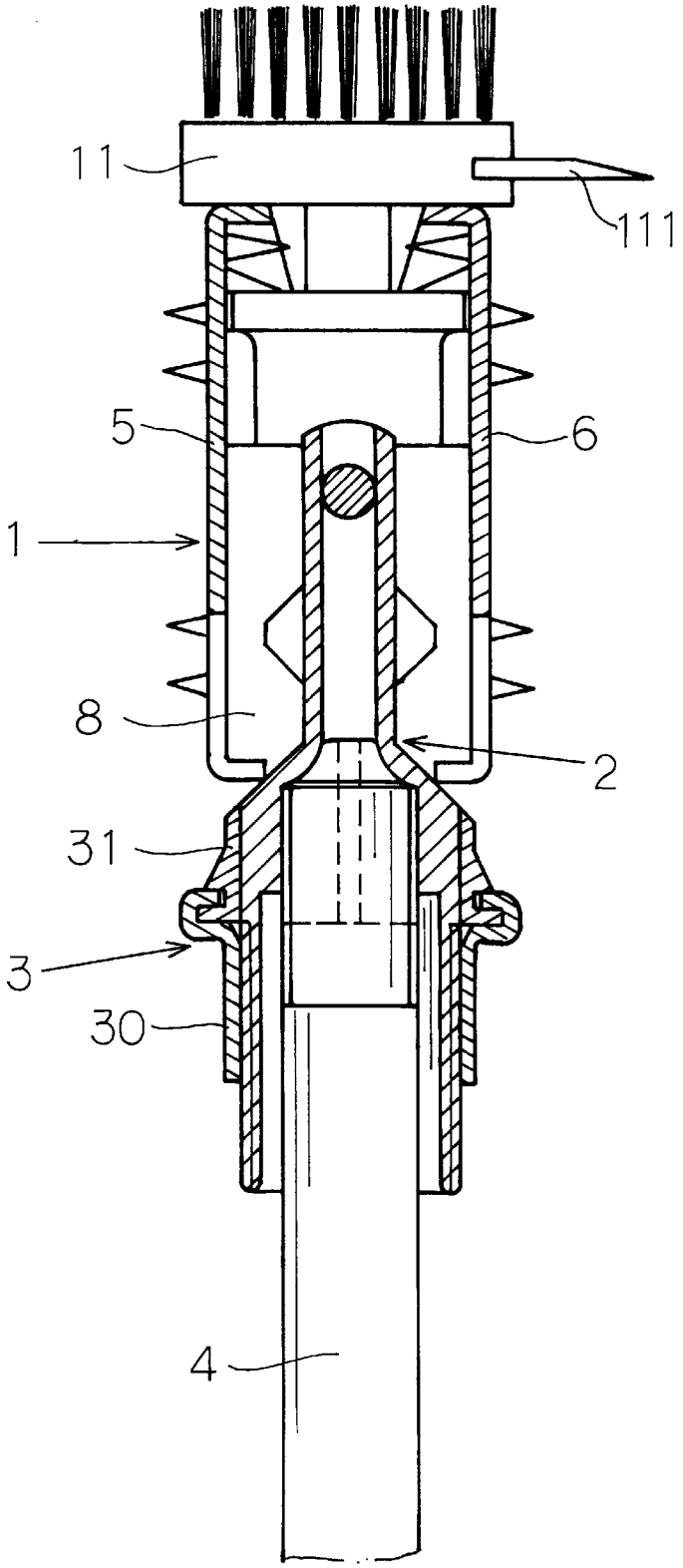
FIG. 11 shows a sectional schematic view of the present invention as shown in FIG. 10.

As shown in FIGS. 8 and 9, the present invention is further composed of a cleaning apparatus 11 having bristles 110, a scraper 111, and a retaining seat 112. The cleaning apparatus 11 is detachably joined with the head 1 such that the retaining seat 112 is retained in the slide groove which is jointly formed by the groove 52 of the upper member 5 and the groove 62 of the lower member 6 of the head 1. The retaining seat 1 12 can be securely retained in light of the clamping force of the upper member 5 and the lower member 6, as illustrated in FIG. 8. In order to allow the cleaning apparatus 11 and the handle 4 to be configured at an angle to bring about the optimum cleaning effect, the urging mechanism 3 can be put to work such that the nut 30 of the urging mechanism 3 is rotated to push the tubular head 31 to move toward the neck 2 so as to cause the two tapered walls 310 of the tubular head 31 to urge the upper end surfaces of the cuts 53 and 63 of the upper member 5 and the lower member 6. In order to put the scraper 111 of the cleaning apparatus 11 to work on a floor surface 14 as shown in FIG. 10, the head 1 and the handle 4 must be first aligned before the nut 30 of the urging mechanism 3 is rotated to push the tubular head 31 in such a way that the tapered walls 310 of the tubular head 31 are retained in a retaining portion which is jointly formed by the protruded seat 8 of the upper member 5 and the protruded seat 8 of the lower member 6, and that the scraper 111 forms an angle of 90 degrees with the handle 4, as shown in FIG. 11.

Figure 12:
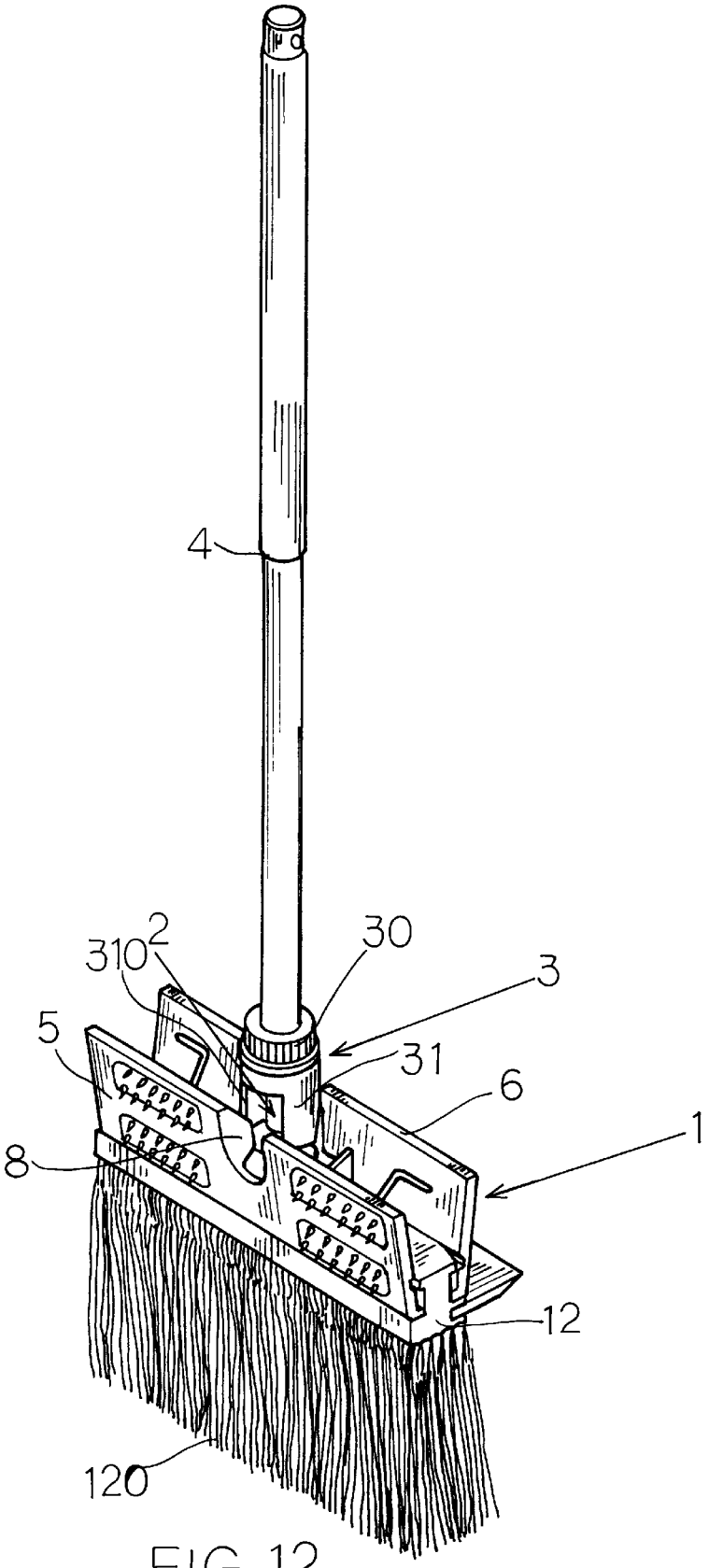
FIG. 12 shows a perspective view of the present invention in use as a broom.

In addition, the cleaning apparatus 11 can be replaced with a broom seat 12, as shown on FIG. 12. The broom seat 12 is similar in construction to the cleaning apparatus 11 and can be thus detachably joined with the head 1 in a manner similar to that by which the cleaning apparatus 11 is attached to the head 1. The broom seat 12 is provided with bristles 120.

Figure 3:
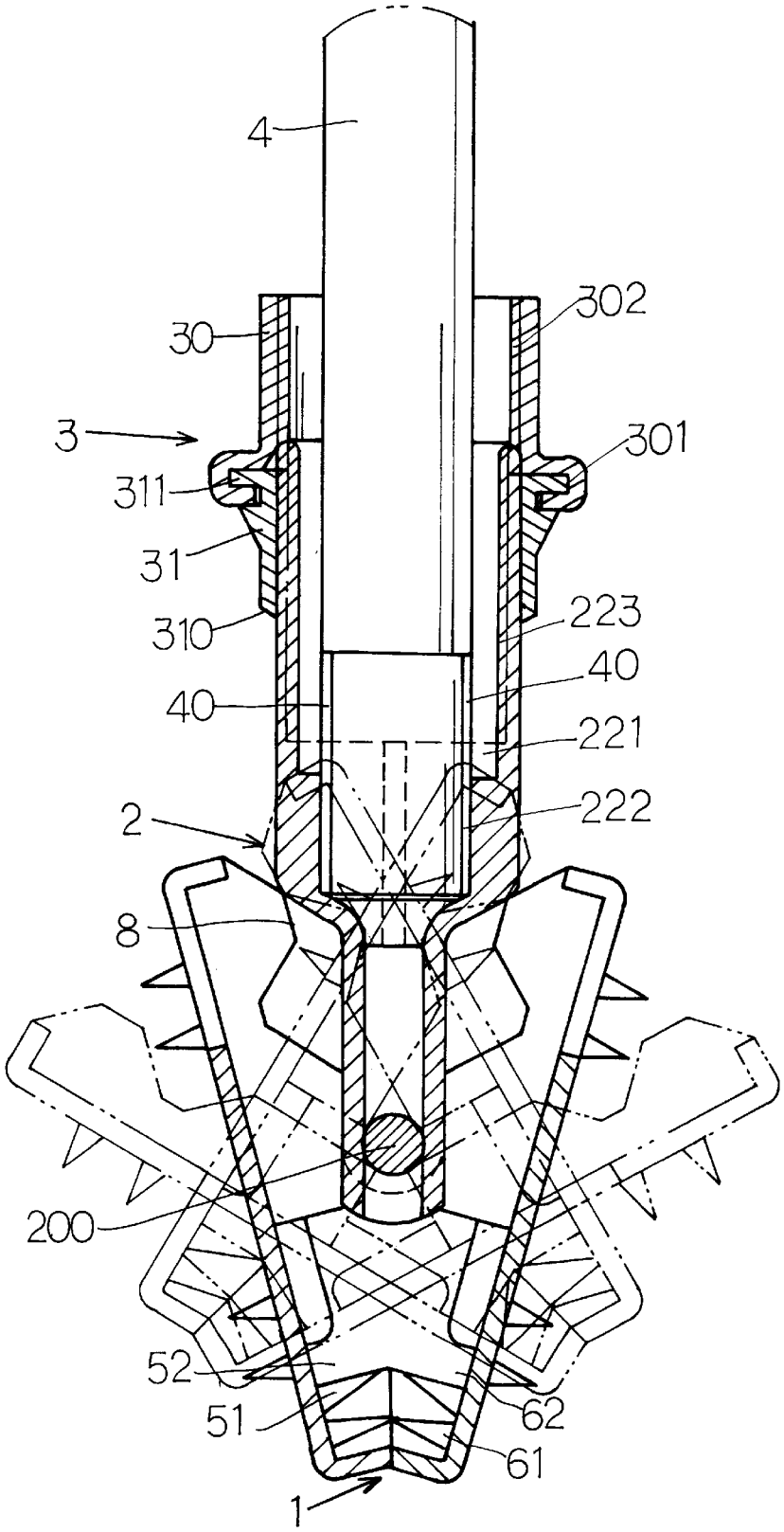
FIG. 3 is a longitudinal section view of the present invention to show that the urging mechanism is moved away from the head of the present invention.
Figure 4:
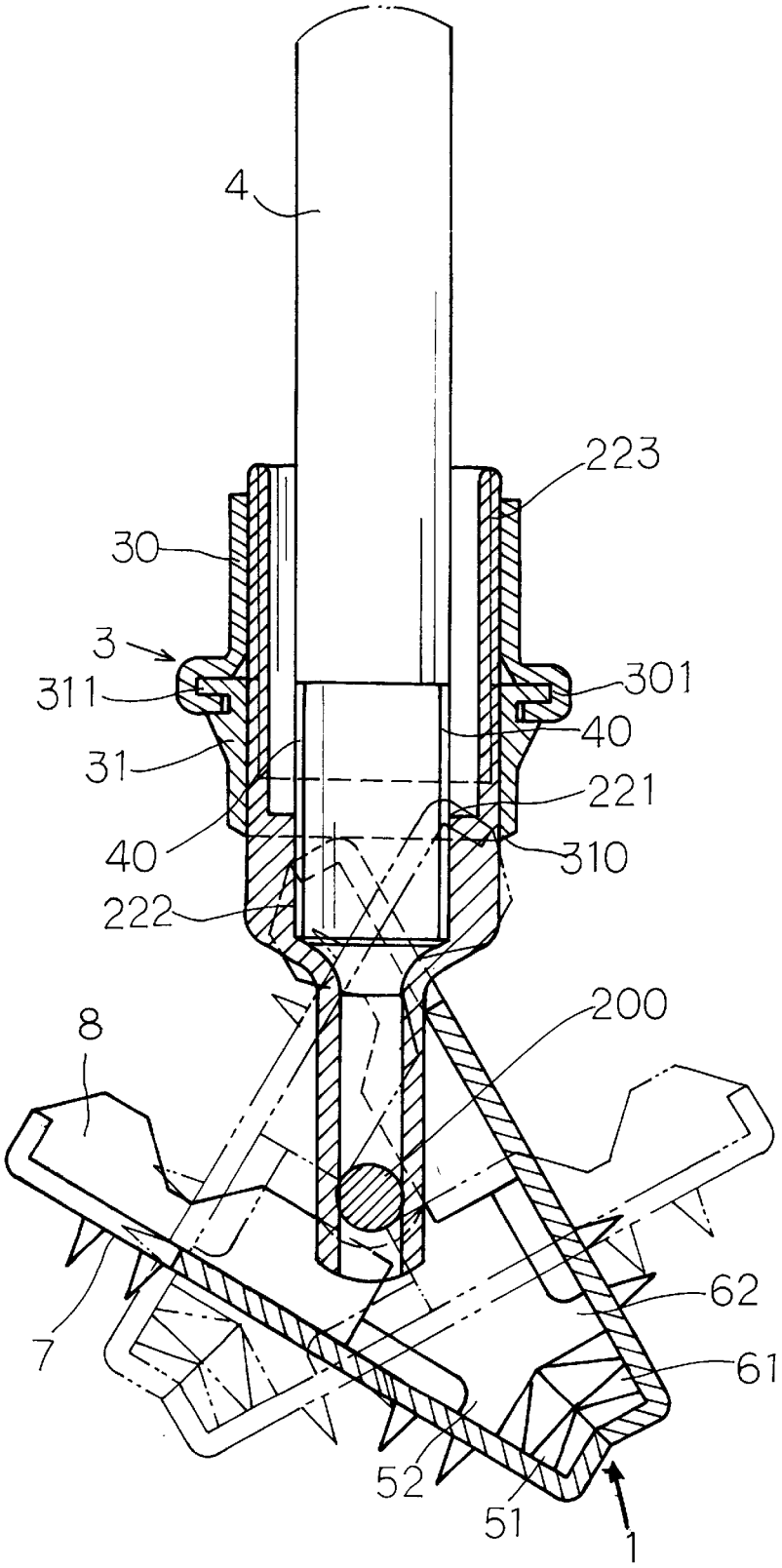
FIG. 4 is a longitudinal sectional view of the present invention to show that the urging mechanism is displaced toward the head of the present invention.
Figure 5:
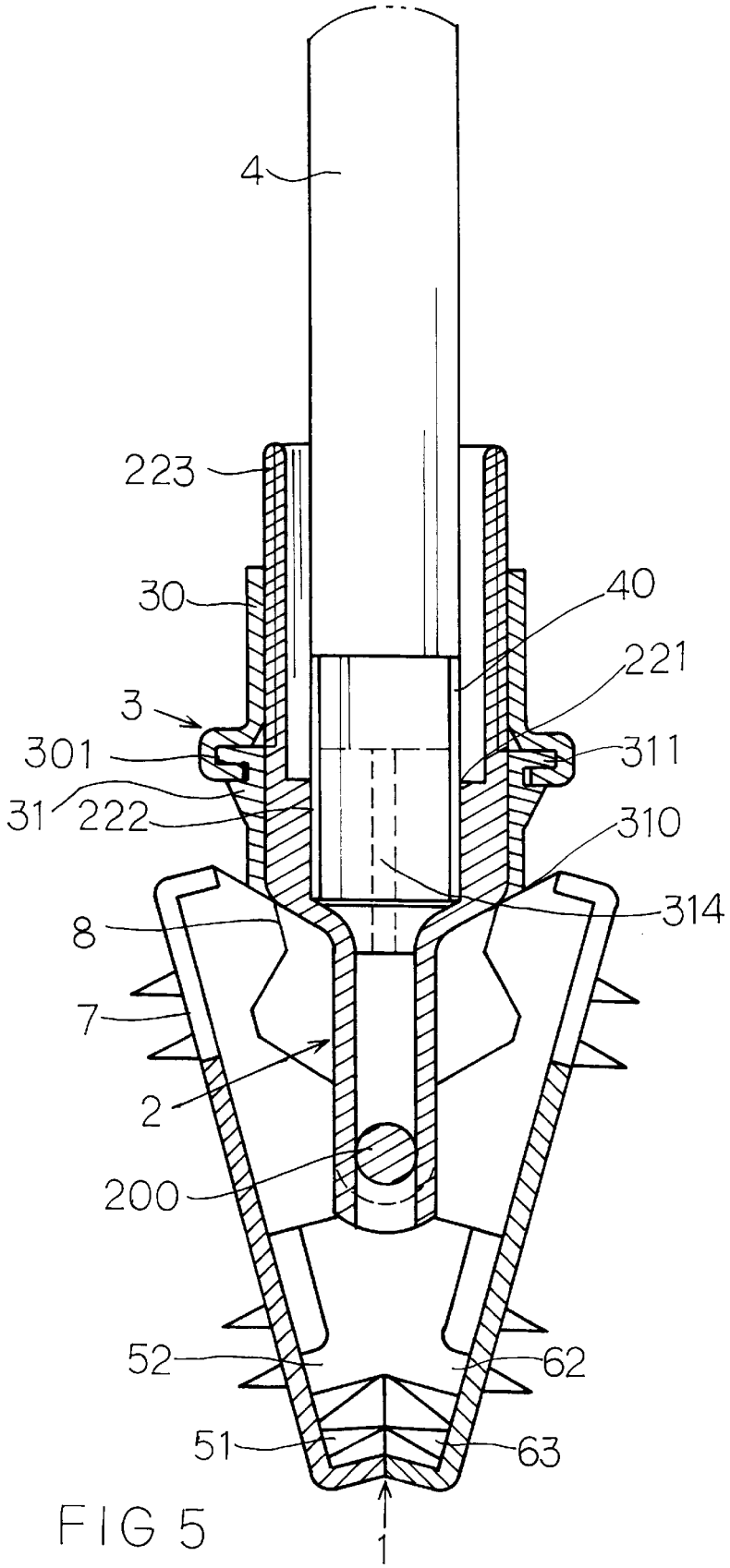
FIG. 5 is a longitudinal sectional view to show that the head, the neck and the handle are aligned and that the urging mechanism is not moved toward the head of the present invention.

As shown in FIG. 3, the head 1 of the present invention can be turned at such time when the urging mechanism 3 is displaced away from the neck 2. In view of the movable head 1 of the present invention, the mop of the present invention can be easily maneuvered.

Figure 13:
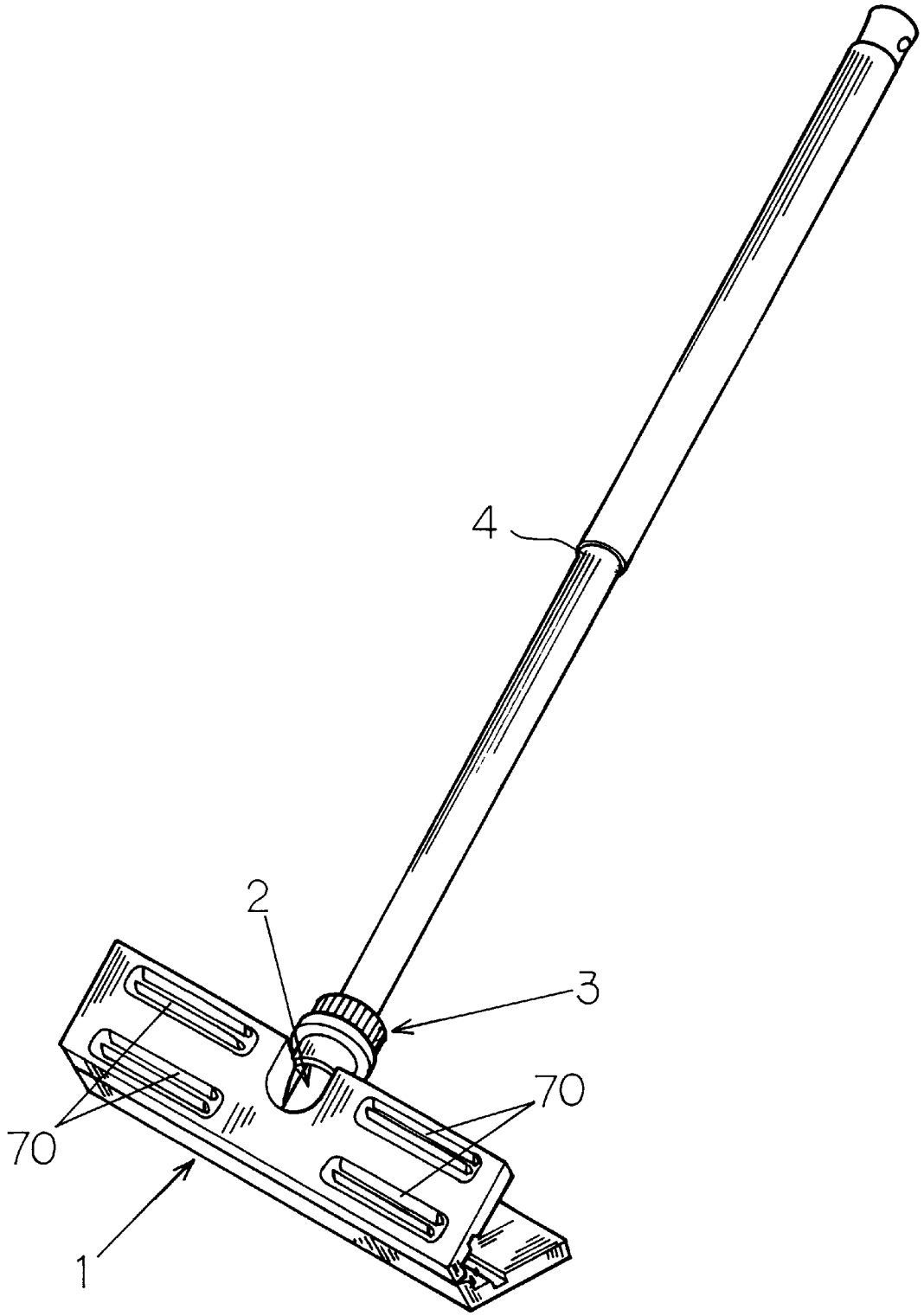
FIG. 13 shows a schematic view of a plurality of modified retaining pieces of the head of the present invention.
Figure 14:
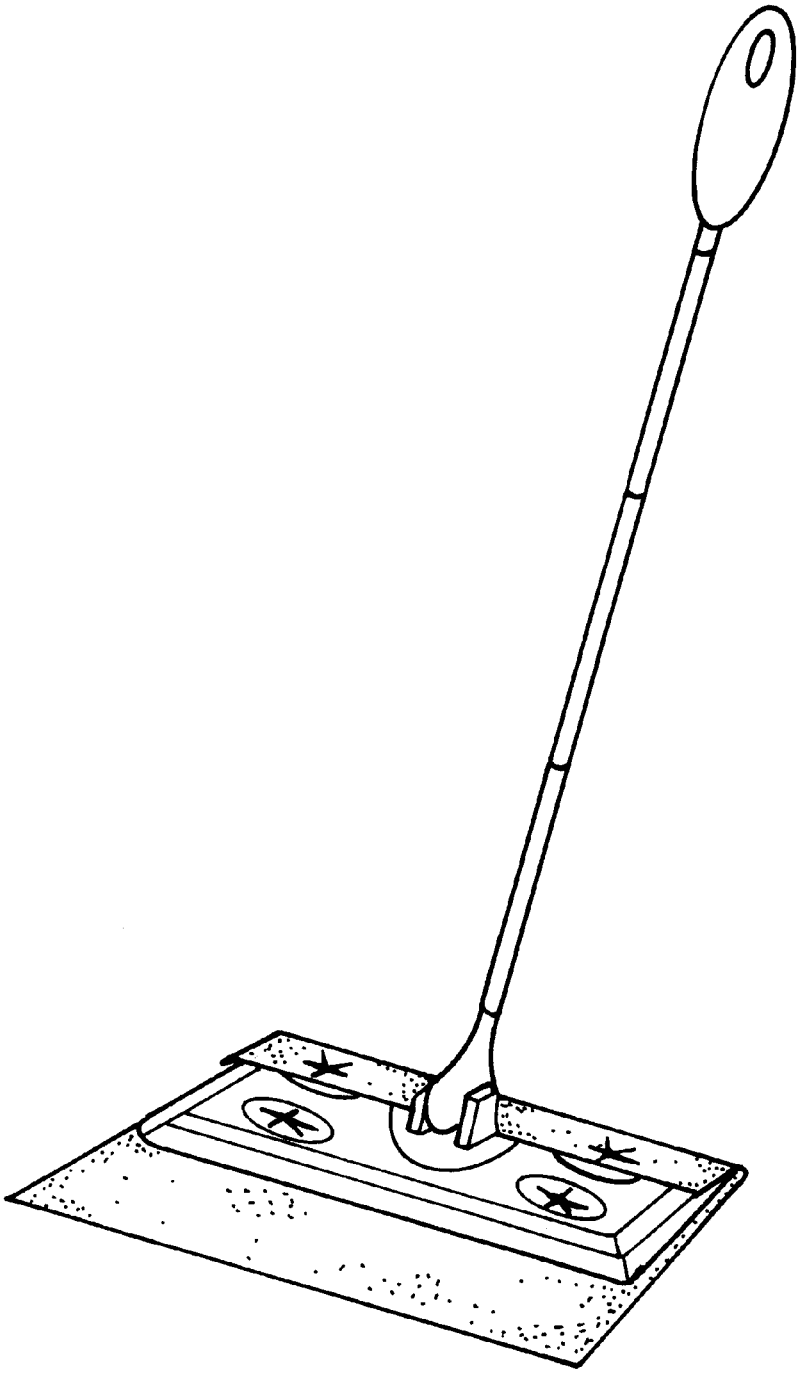
FIG 14 PRIOR ART
FIG. 14 shows a perspective view of a prior art mop.

The embodiments of the present invention described above are to be deemed in all respects as being merely illustrative and not restrictive. Accordingly, the present invention may be embodied in other specific forms without deviating from the spirit thereof. For example, the tapered knobs of the retaining pieces 7 of the head 1 of the present invention may be replaced with the ridges 70, as shown in FIG. 13. Like tapered knobs, the ridges 70 are capable of retaining securely the mopping cloth 100. The present invention is therefore to be limited only by the scopes of the following appended claims.

What is claimed is:

1. A floor cleaning device comprising:

a head made up of an upper member of a rectangular construction, and a lower member corresponding in shape and size to said upper member, said upper member provided in an upper surface thereof with a plurality of receiving slots and a plurality of retaining pieces dimensioned to fit securely into said receiving slots and provided respectively in an upper surface thereof with a plurality of tapered knobs, said upper member further provided in an underside thereof with a plurality of toothed rows extending along an edge of one longitudinal side of said upper member, and a groove extending in the proximity of said toothed rows, said upper member still further provided at a center of the other longitudinal side thereof with a cut and a protruded seat contiguous to said cut, said upper member still further provided in the underside thereof with two locating sets each having two blocks which are opposite to each other at an interval and are provided respectively with a through hole, said lower member provided in an upper surface thereof with a plurality of receiving slots and a plurality of retaining pieces dimensioned to fit securely into said receiving slots of said lower member and provided respectively in an upper surface thereof with a plurality of tapered knobs, said lower member further provided in the upper surface thereof with a plurality of toothed rows corresponding in location to said toothed rows of said upper member, and a groove corresponding in dimension and location to said groove of said upper member such that said groove of said upper member and said groove of said lower member form jointly a slide groove at such time when said upper member and said lower member are joined together, said lower member still further provided with a cut corresponding in location to said cut of said upper member, and a protruded seat contiguous to said cut of said lower member, said lower member still further provided in the upper surface thereof with two retaining sets each having two retaining blocks which are opposite to each other at an interval and are located between said two retaining blocks of corresponding retaining set of said upper member at the time when said upper member and said lower member are joined together, said lower member still further provided with a plurality of springs which are located respectively between said two retaining blocks of each of said two retaining sets, said two retaining blocks of said two retaining sets of said lower member provided respectively with a through hole, said upper member and said lower member being held together by a retaining rod which is received in said through holes of said retaining sets of said upper member and said lower member such that said retaining rod is fitted into said springs;

a neck of a T-shaped construction and having a head end which is provided with a cross rod having a through hole, said neck being fastened with said head such that said cross rod is located between said two retaining sets of said head, and that said retaining rod is received in said through hole of said cross rod, said neck further having a shank extending from said head end of said neck such that said shank is perpendicular to said cross rod, said neck still further having a fastening portion of a tubular construction and extending from a free end of said shank, said fastening portion provided in an axial hole thereof with inner threads and in an outer wall of said free end thereof with outer threads, said fastening portion further provided in an outer wall thereof with two locating ridges opposite to each other and contiguous to said shank;

an urging mechanism composed of a nut and a tubular head, said nut provided in an inner wall of one end thereof with a circular retaining groove and inner threads, said tubular head provided at one end thereof with two tapered walls and at other end thereof with a circular retaining protrusion and an indentation, said tubular head further provided in an inner wall of an axial hole thereof with two locating grooves, said tubular head being engaged with said nut such that said circular retaining protrusion of said tubular head is retained in said circular retaining groove of said nut, said urging mechanism being fitted over said fastening portion of said neck such that said two locating ridges of said fastening portion are securely located in said two locating grooves of said tubular head, and that said outer threads of said fastening portion are engaged with said inner threads of said nut, and further that said tubular head can be caused to displace by turning said nut; and a handle provided at one end thereof with outer threads and fastened with said neck via said urging mechanism such that said handle is put through said nut and said tubular head, and that said outer threads of said handle are engaged with said inner threads of said axial hole of said fastening portion of said neck.

2. The floor cleaning device as defined in claim 1 further comprising a cleaning apparatus having bristles, a scraper and a retaining seat, said cleaning apparatus being detachably fastened with said head such that said retaining seat of said cleaning apparatus is retained in the slide groove which is jointly formed by said groove of said upper member and said groove of said lower member of said head, and that said cleaning apparatus and said handle can be configured at an angle by rotating said nut of said urging mechanism so as to push said tubular head of said urging mechanism to move toward said neck to cause said two tapered walls of said tubular head to urge upper end surfaces of said cuts of said upper member and said lower member of said head, and further that said scraper of said cleaning apparatus can be caused to form an angle of 90 degrees with said handle by a first step in which said head and said handle are aligned before said nut of said urging mechanism is rotated to push said tubular head in such a way that said tapered walls of said tubular head of said urging mechanism are retained in a retaining portion which is jointly formed by said protruded seats of said upper member and said lower member of said head.

3. The floor cleaning device as defined in claim 1, wherein said retaining pieces of said upper member and said lower member of said head are provided with a plurality of ridges in place of said tapered knobs.

* * * * *